US007404231B2

(12) United States Patent
Kang

(10) Patent No.: US 7,404,231 B2
(45) Date of Patent: Jul. 29, 2008

(54) DUST CONTAINER OF UPRIGHT TYPE VACUUM CLEANER AND SUPPORTING STRUCTURE FOR COVER THEREOF

(75) Inventor: Sang Bo Kang, Incheon-si (KR)

(73) Assignee: Daewoo Electronics Corporation, Seoul (KR)

( * ) Notice: Subject to any disclaimer, the term of this patent is extended or adjusted under 35 U.S.C. 154(b) by 78 days.

(21) Appl. No.: 11/504,579

(22) Filed: Aug. 16, 2006

(65) Prior Publication Data

US 2007/0039127 A1 Feb. 22, 2007

(30) Foreign Application Priority Data

Aug. 18, 2005 (KR) ..... 10-2005-0075736
Aug. 18, 2005 (KR) ..... 10-2005-0075737

(51) Int. Cl.
*A47L 9/16* (2006.01)

(52) U.S. Cl. ..... 15/353; 15/347

(58) Field of Classification Search ..... 15/353, 15/350, 347; 55/327, 429, 459.1
See application file for complete search history.

(56) References Cited

U.S. PATENT DOCUMENTS 5,309,600 A 5/1994 Weaver et al.
5,524,321 A 6/1996 Weaver et al.
5,715,566 A 2/1998 Weaver et al.
6,406,505 B1 * 6/2002 Oh et al. ..... 55/337
6,532,620 B2 * 3/2003 Oh ..... 15/353
6,579,334 B2 * 6/2003 Oh et al. ..... 55/426
6,732,406 B2 * 5/2004 Oh ..... 15/352
6,868,578 B1 3/2005 Kasper et al.
7,022,154 B2 * 4/2006 Oh ..... 55/426
7,128,770 B2 * 10/2006 Oh et al. ..... 55/343
7,188,388 B2 * 3/2007 Best et al. ..... 15/329
7,273,506 B2 * 9/2007 Oh et al. ..... 55/343
2003/0159411 A1 8/2003 Hansen et al.
2005/0252180 A1 * 11/2005 Oh et al. ..... 55/345

* cited by examiner

*Primary Examiner*—David B Thomas
(74) *Attorney, Agent, or Firm*—Nath Law Group; Jerald L. Meyer; Stan N. Protigal

(57) ABSTRACT

A dust container of an upright type vacuum cleaner includes a circular cover having a suction port and an exhaust port, a guide member attached to a lower surface of the cover to guide an air flow, a filter attached to a lower surface of the guide member, and a cylindrical container body provided to the lower surface of the cover to receive the guide member and the filter. The guide member guides air induced into the dust container through a suction port to spirally rotate within the container body. A supporting member positioned within the container body supports the filter such that the filter supports the cover.

11 Claims, 10 Drawing Sheets

DUST CONTAINER OF UPRIGHT TYPE VACUUM CLEANER AND SUPPORTING STRUCTURE FOR COVER THEREOF

BACKGROUND OF THE INVENTION

1. Field of the Invention

The present invention relates to a vacuum cleaner. More particularly, the present invention relates to a dust container of an upright type vacuum cleaner, which is formed at an upper surface with a suction port to allow air containing foreign substances to be induced therethrough, and an exhaust port to allow purified air to be exhausted to an outside thereof, thereby maintaining a suction force of the vacuum cleaner while ensuring closing properties of the dust container, and to a supporting structure for a cover of the dust container, which is adapted to prevent a downward deformation of the cover by use of a filter even when a vacuum degree increases within the dust container during driving of the vacuum cleaner.

2. Description of the Related Art

According to shapes and using postures, vacuum cleaners can be generally classified into a canister type vacuum cleaner, which provides convenience in corner cleaning and movement while allowing easy replacement of a brush and a nozzle, and an upright type vacuum cleaner, which provides convenience in maintenance and allows easy cleaning of a large space.

FIG. 1 is a perspective view illustrating a conventional upright type vacuum cleaner.

The conventional upright type vacuum cleaner comprises a suction head 2 serving to suck air containing foreign substances on a floor, a main body 4 mounted on the suction head 2 and having a suction device to suck the air, and a handle 6 installed to an upper portion of the body 4 so as to be gripped by a user.

The suction head 2 serves to suck the air containing the foreign substances in conjunction with an operation of the vacuum cleaner through a suction port formed at a lower surface of the suction head 12 while moving on a floor desired to be cleaned. That is, the air is sucked through the lower surface of the suction head 2 by the operation of the suction device received within the main body 4.

A lower portion of the main body 4 is hinged to a rear side of the suction head 2 such that the body 4 can be tilted rearward by a predetermined angle with respect to the suction head 2.

An upper portion of the main body 4 is provided with the handle 6 such that the user can grip the handle, and manipulate the whole vacuum cleaner during the cleaning operation.

For example, while performing the cleaning operation for a target location, the user grips the handle 6, and adjusts an inclined angle of the main body 4 with respect to the suction head 2.

A dust container 8 is detachably installed to a front center of the main body 4. The dust container 8 filters the foreign substances contained in the air flowing thereto through the suction head, and collects the filtered foreign substances therein.

For the conventional vacuum cleaner shown in the drawing, the dust container is illustrated as collecting the foreign substances contained in the air, which is suctioned in a cyclonic manner.

For an air flow within the conventional upright type vacuum cleaner constructed as above, air containing the foreign substances is first suctioned through a suction port formed at the lower surface of the suction head 2 via operation of the suction means received in the main body 4.

Then, the air flows into the dust container 8 via the main body 4. With the foreign substances removed from the air within the dust container 8, the air is exhausted from the dust container 8 to the outside through an exhaust port via the main body 4.

Meanwhile, FIG. 2 is a perspective view illustrating the dust container of FIG. 1. Referring to FIG. 2, the dust container 8 is formed at an upper portion with a suction port 21, and at a lower portion with an exhaust port 22.

If the dust container has the suction port formed at the upper portion and the exhaust port formed at the lower portion, however, shielding force is increased at the suction port side due to an increase in vacuum degree during driving of the vacuum cleaner, causing suction force of the vacuum cleaner to be lowered.

FIG. 3 is a cross sectional view illustrating the dust container of the conventional upright type vacuum cleaner.

As shown in FIG. 3, the dust container of the conventional upright type vacuum cleaner serves to collect the foreign substances after filtering it from the air passing therethrough, and to allow the air to be discharged to the outside after being filtered by the filter therein.

In order to perform such a function, the dust container 10 has the suction port and the exhaust port formed through a cover 12 which covers an upper portion of a container body 11, and which is provided at a lower surface thereof with a guide member 13 to guide air induced through the suction port towards the container body 11 while guiding the air purified through the container body 11 towards the exhaust port.

In addition, a filter 14 is attached to a lower surface of the guide member 13 to purify the contaminated air.

Accordingly, while the contaminated air flows spirally within an interior of the container body along the guide member after passing through the suction port of the cover, foreign substances over a predetermined weight drop onto the bottom of the container body, and air is exhausted to the outside through the exhaust port of the cover along the guide member after being purified through the filter.

However, as a degree of vacuum is increased according to driving of the vacuum cleaner, the exhaust port of the cover is compressed, causing an edge of the cover to be widened and a central region thereof to be deformed downwardly. As a result, sealing of the dust container is not sufficiently ensured.

Accordingly, there is a need of an improved vacuum cleaner which overcomes the above problem.

SUMMARY OF THE INVENTION

Therefore, the present invention has been made in view of the above problems of the conventional vacuum cleaner, and it is an object of the present invention to provide a vacuum cleaner, which has a suction port serving to suck contaminated air, and an exhaust port serving to exhaust purified air formed on an upper surface of a dust container serving to filter dust, thereby preventing reduction in suction force of the vacuum cleaner.

In accordance with an aspect of the present invention, the above and other objects can be accomplished by the provision of a dust container of an upright type vacuum cleaner, comprising: a circular cover having a suction port and an exhaust port; a guide member attached to a lower surface of the cover to guide a flow path of air; a filter attached to a lower surface of the guide member; and a cylindrical container body provided to the lower surface of the cover to receive the guide member and the filter therein.

Preferably, the guide member comprises a suction guide part to guide air induced into the dust container through the suction port of the cover to spirally rotate within the container body, and an exhaust guide part to guide air discharged towards a center of the filter to the exhaust port of the cover.

Preferably, the suction guide part comprises a suction guide plate to guide the induced air to rotate, and a slanted plate formed at a distal end of the suction guide plate and having a slanted opening defined therein to guide the induced air to move towards the container body.

Preferably, the exhaust guide part comprises an exhaust hole through which the air purified by the filter is exhausted to the outside, and an exhaust guide plate to guide the air exhausted through the exhaust hole to the exhaust port of the cover.

Preferably, the dust container further comprises a gasket between the guide member and the cover. Preferably, the gasket has a larger diameter than that of the cover.

Preferably, the dust container further comprises ribs extending with different lengths from the suction port and the exhaust port on the lower surface of the cover to the guide parts, respectively.

In accordance with another aspect of the present invention, a supporting structure for a cover of a dust container of an upright type vacuum cleaner is provided, comprising: a circular cover having a suction port and an exhaust port; a guide member attached to a lower surface of the cover to guide a flow path of air; a filter attached to a lower surface of the guide member; a cylindrical container body provided to the lower surface of the cover to receive the guide member and the filter therein; and a supporting member provided to an inner side of the container body to support the filter.

Preferably, the supporting member comprises a supporting plate located under a lower surface of the filter to support the filter, and securing plates extending from the supporting plate and attached to the inner side of the container body.

Preferably, at least one of the securing plates is separated from others to define a space therebetween, and the space is formed with an opening through which the air can flow.

Preferably, the supporting plate is formed with a securing protrusion on which the filter is seated.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Preferred embodiments of the present invention will be described in detail with reference to the accompanying drawings as follows.

Figure 1:
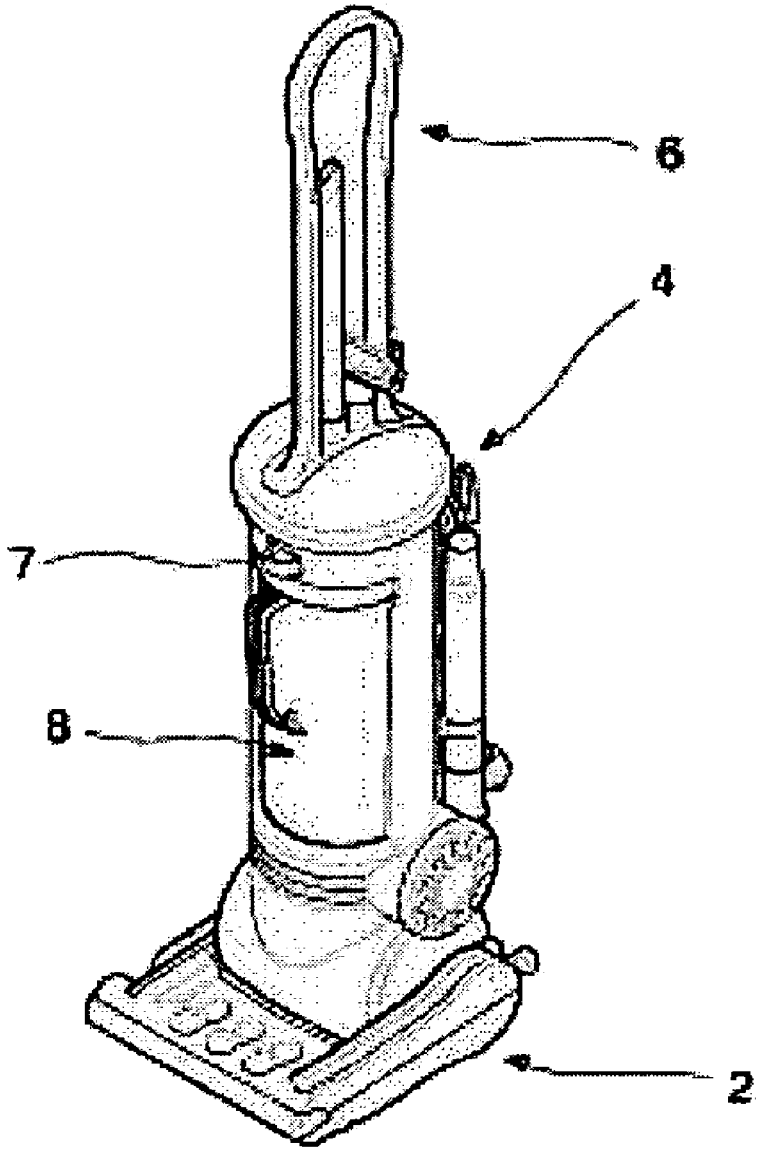
FIG. 1 (Prior Art)
FIG. 1 is a perspective view illustrating a conventional upright type vacuum cleaner.
Figure 2:
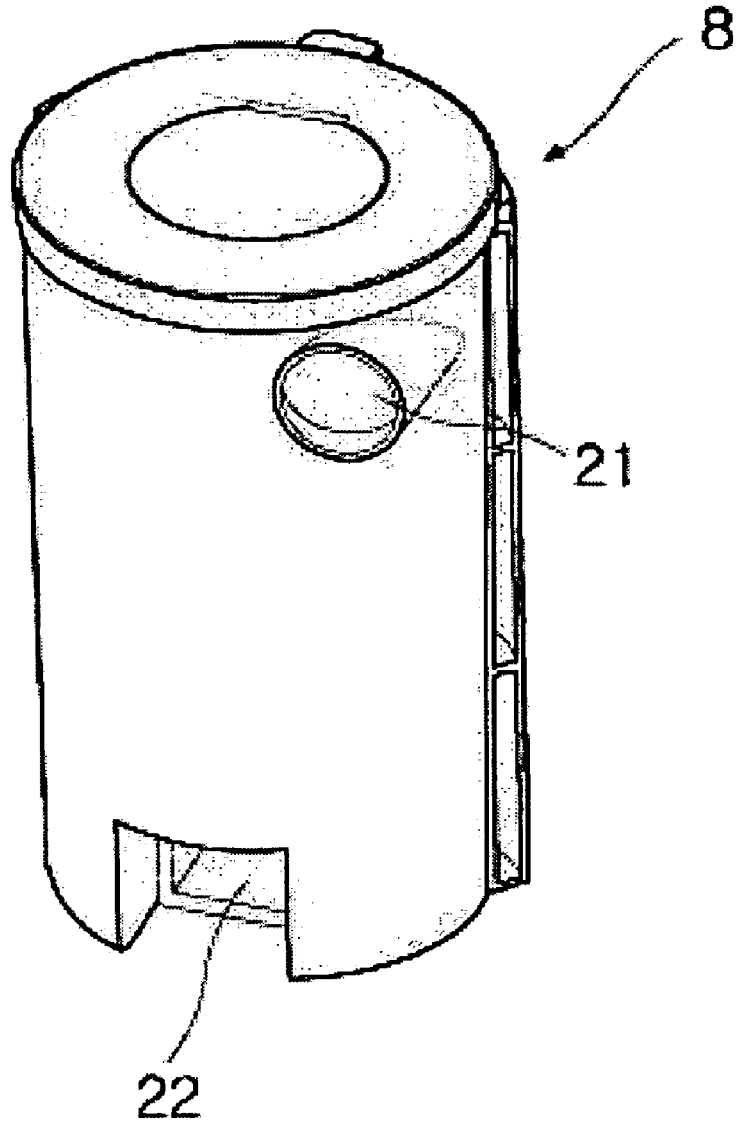
FIG. 2 (Prior Art)
FIG. 2 is a perspective view illustrating a dust container shown in FIG. 1.
Figure 3:
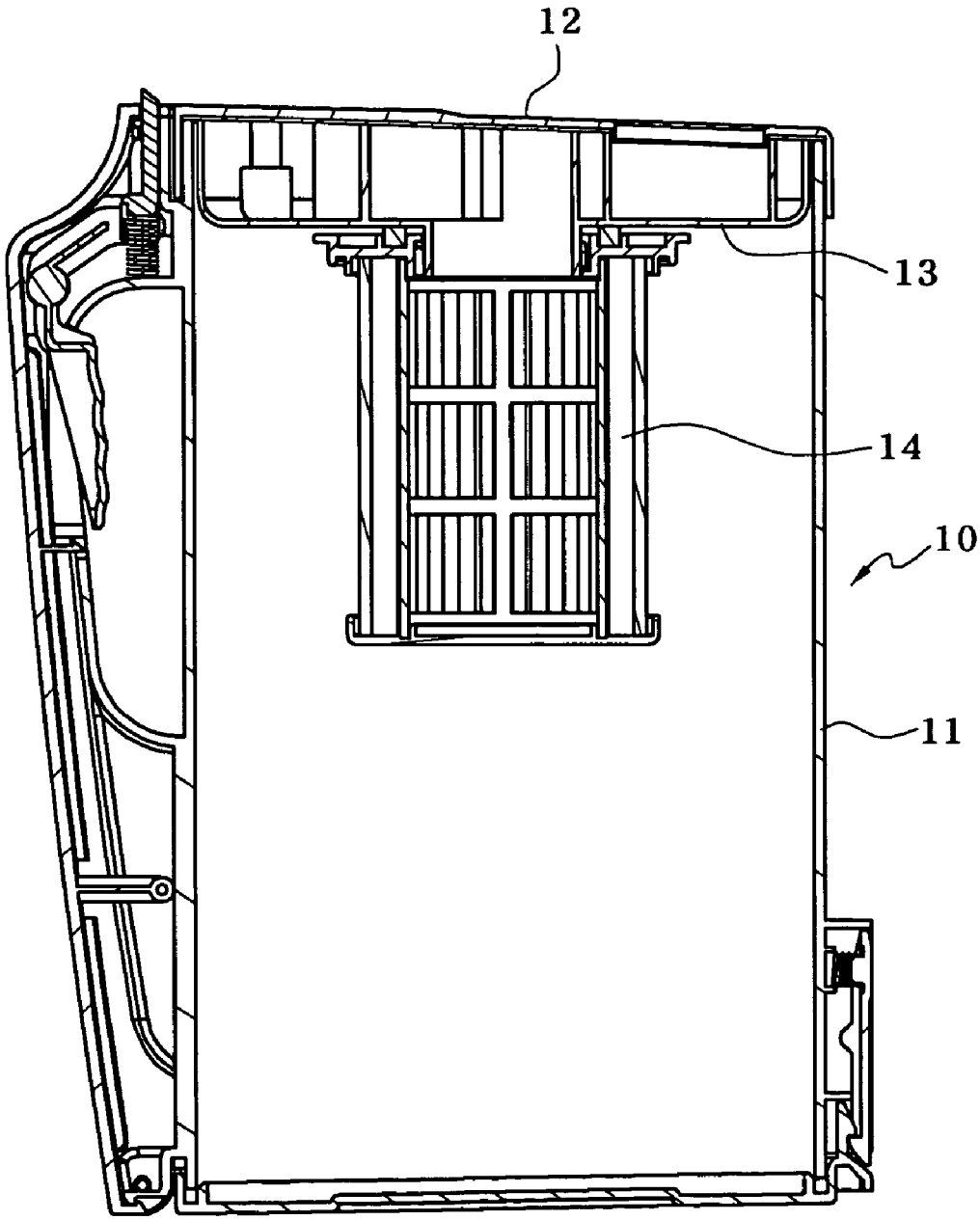
FIG. 3 (Prior Art)
FIG. 3 is a cross sectional view illustrating the dust container of the conventional upright type vacuum cleaner.
Figure 4:
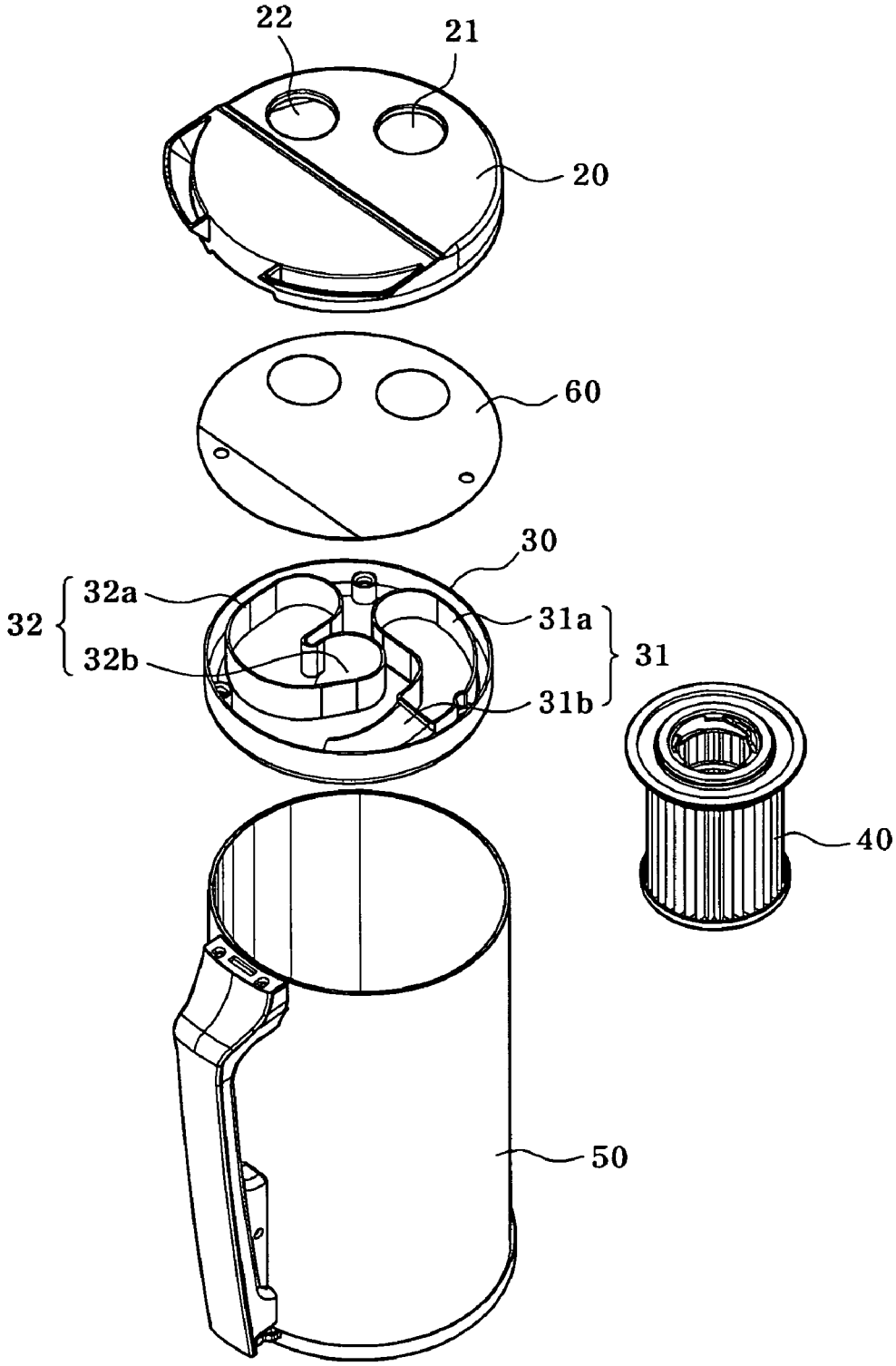
FIG. 4 is an exploded perspective view illustrating a dust container of an upright type vacuum cleaner according to the present invention.
Figure 5:
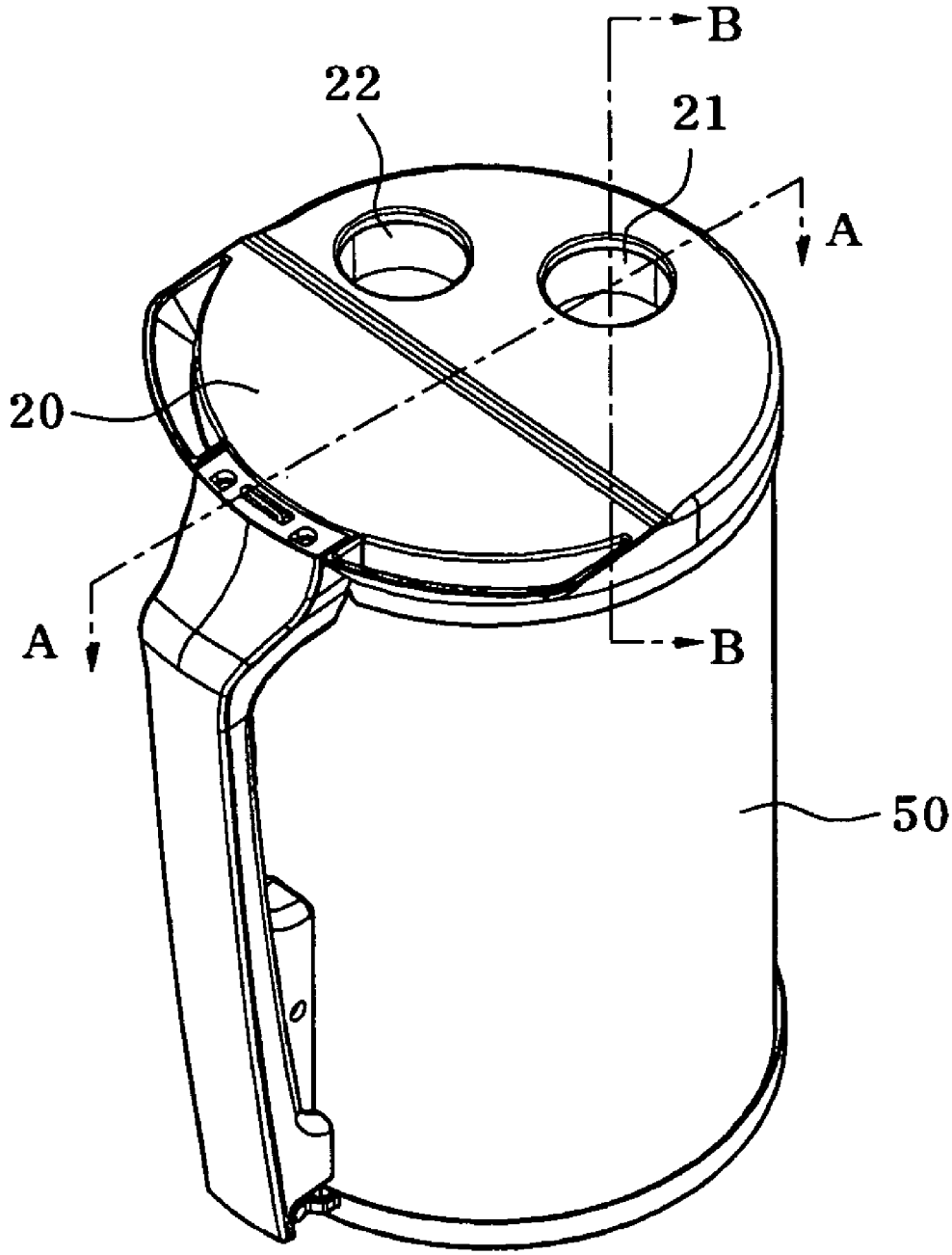
FIG. 5 is an assembled perspective view illustrating the dust container of the upright type vacuum cleaner according to the present invention.
Figure 6:
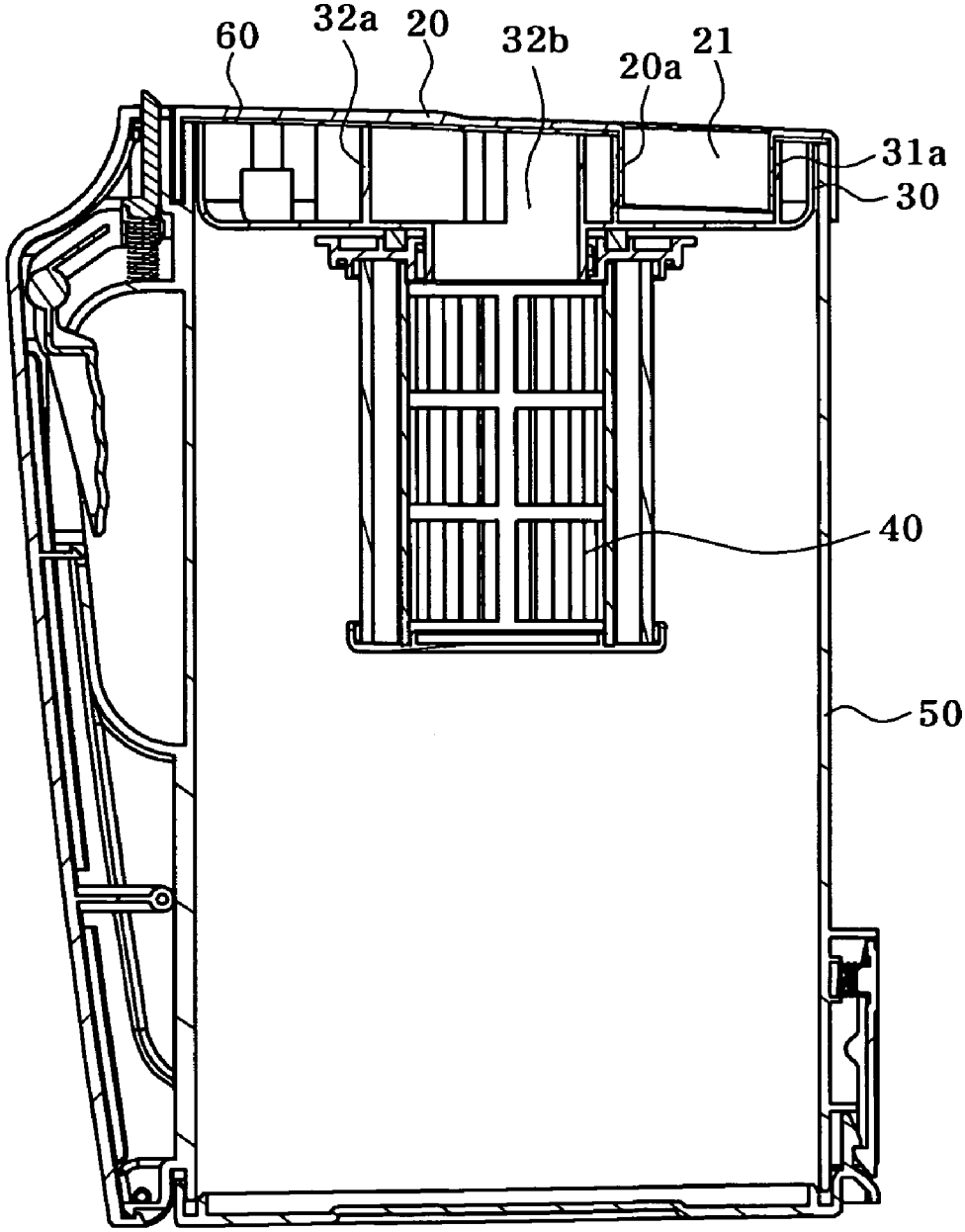
FIG. 6 is a cross-sectional view taken along line A-A of FIG. 5.
Figure 7:
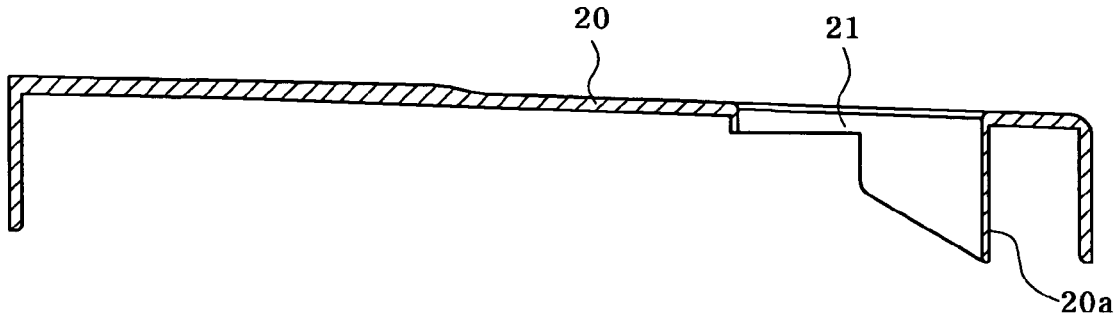
FIG. 7 is a cross-sectional view taken along line B-B of FIG. 5, illustrating a cover according to the present invention.
Figure 8:
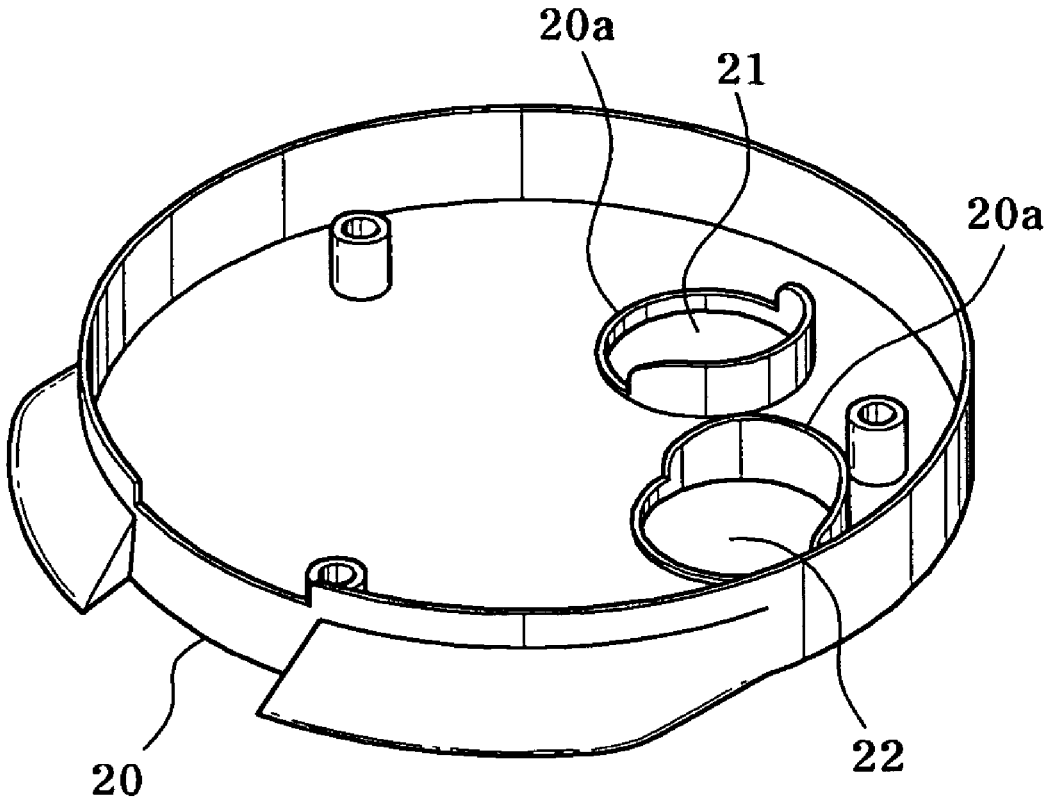
FIG. 8 is a bottom perspective view illustrating the cover according to the present invention.

FIG. 4 is an exploded perspective view illustrating a dust container of an upright type vacuum cleaner according to the present invention, FIG. 5 is an assembled perspective view illustrating the dust container of the upright type vacuum cleaner according to the present invention, and FIG. 6 is a cross-sectional view taken along line A-A of FIG. 5. FIG. 7 is a cross-sectional view taken along line B-B of FIG. 5, illustrating a cover according to the present invention, and FIG. 8 is a bottom perspective view illustrating the cover according to the present invention.

A dust container of an upright type vacuum cleaner according to the present invention has a cylindrical shape, and is provided at an upper end with a cover 20.

The cover 20 has a circular shape, and is formed with a suction port 21 and an exhaust port 22 to which a suction pipe and an exhaust pipe provided to a main body (not shown) of the vacuum cleaner are coupled.

A guide member 30 is attached to a lower surface of the cover 20 to guide a flow path of air. The guide member 30 has a disc shape having a smaller diameter than that of the cover 20, and is communicated with the suction port 21 and the exhaust port 22.

A filter 40 is attached to a lower surface of the guide member 30, and a cylindrical container body 50 is attached to a circumference of the lower surface of the cover 20.

Here, the guide member 30 and the filter 40 are located at an upper portion of an interior of the container body 50 in which foreign substances are separated from air induced into the dust container through the suction port 21, and settle down to the bottom while the air is discharged through the exhaust port 22 after being purified by the filter 40.

The guide member 30 comprises a suction guide part 31 to guide the air induced through the suction port 21 of the cover 20 to spirally rotate within the container body 50, and an exhaust guide part 32 to guide the purified air discharged towards a center of the filter 40 to the exhaust port 22 of the cover 20.

As an example, the suction guide part 31 comprises a suction guide plate 31*a* to guide the induced air to flow rotationally along an edge of the guide member 30, and a slanted plate 31*b* formed at a distal end of the suction guide plate 31*a* and having a slanted opening formed through the slanted plate 31*b*.

The slanted opening formed through the slanted plate 31*b* serves to spontaneously guide the air induced through the suction guide plate 31*a* to the container body 50.

The exhaust guide part 32 comprises an exhaust hole 32*b* through which the air purified by the filter is exhausted to the outside, and an exhaust guide plate 32*a* to guide the air exhausted through the exhaust hole 32*b* to the exhaust port 22 of the cover 20.

Preferably, the dust container of the present invention further comprises a gasket 60 between the guide member 30 and the cover 20 to prevent air leakage through a gap therebetween.

The gasket 60 is designed to have a diameter larger than that of the cover 20 in order to enhance sealing force of the cover 20 and the guide member 30 while enhancing sealing force resulting from engagement between the cover 20 and the container body 50.

Furthermore, ribs 20*a* are protruded from the lower surface of the cover 20 corresponding to the suction port 21 and the exhaust port 22, respectively.

That is, one of the ribs 20*a* extends from the suction port 21 to guide the air induced therethrough to the suction guide part 31 of the guide member 30, and the other extends from the exhaust port 22 to guide the air from the exhaust guide part 32 to the exhaust port 22 so as to be exhausted through the exhaust port 22.

At this time, each of the ribs 20*a* has a cylindrical shape, and is varied in length. Specifically, for the rib 20*a* corresponding to the suction port 21, a portion of the rib 20*a* contacting the suction guide plate 31*a* of the suction guide part 31 extends further than other portions of the rib 20*a*. Likewise, for the rib 20*a* corresponding to the exhaust port 22, a portion of the rib 20*a* contacting the exhaust guide plate 32*a* of the exhaust guide part 32 extends further than other portions of the rib 20*a*.

Operation and effect of the dust container according to the present invention will be described hereinafter.

A suction pipe of the main body (not shown) of the upright type vacuum cleaner is coupled to the suction port 21 of the cover 20 installed to the upper end of the dust container, and an exhaust pipe of the main body is coupled to the exhaust port 22 of the cover.

In this state, when the vacuum cleaner is operated, air containing dust and other foreign substances suctioned through a suction head (not show) of the vacuum cleaner is induced into the container body 50 along the suction guide part 31 of the guide member 30 through the suction port 21 of the cover 20.

In other words, after passing through the suction port 21, the air circulates along the suction guide plate 31*a* of the suction guide part 31 within the guide member 30, moves spontaneously downwards through the slanted opening formed in the slanted plate 31*b*, and flows to the container body 50. The air induced into the container body 50 circulates in a spiral shape therein.

The spiral circulation of the air imparts a centrifugal force to the air induced into the container body 50.

The centrifugal force serves to cause the foreign substances over a predetermined weight to drop down on the bottom of the container body 40 while forcing the induced air to circulate within the container body 50 without directly flowing towards the filter 40.

Accordingly, the foreign substances over the predetermined weight is collected on the bottom of the container body 50, while the air is exhausted to the outside through the exhaust guide part 32 of the guide member 30 after moving upwardly and being purified by the filter 40.

As such, after being purified by the filter 40, air passes through the exhaust hole 32*b* of the exhaust guide part 32 communicated with a void space at the center of the filter 40, flows to the exhaust port 22 of the cover 20 through the exhaust guide plate 32*a*, and is exhausted to the outside through the exhaust pipe of the main body.

Meanwhile, the gasket 60 disposed between the cover 20 and the guide member 30 serves to prevent air leakage. In addition, the ribs 20*a* formed on the lower surface of the cover 20 have variable lengths, and closely contact the suction guide plate 31*a* and the exhaust guide plate 32*a*, respectively, to ensure sealing of the suction port and the exhaust port while providing flow passages of air.

As such, according to the present invention, the suction port and the exhaust port are formed on the cover located on the upper end of the dust container, thereby preventing reduction of suction force, which occurs in a conventional dust container having a suction port formed at an upper portion thereof and an exhaust port formed at a lower portion thereof.

Figure 9:
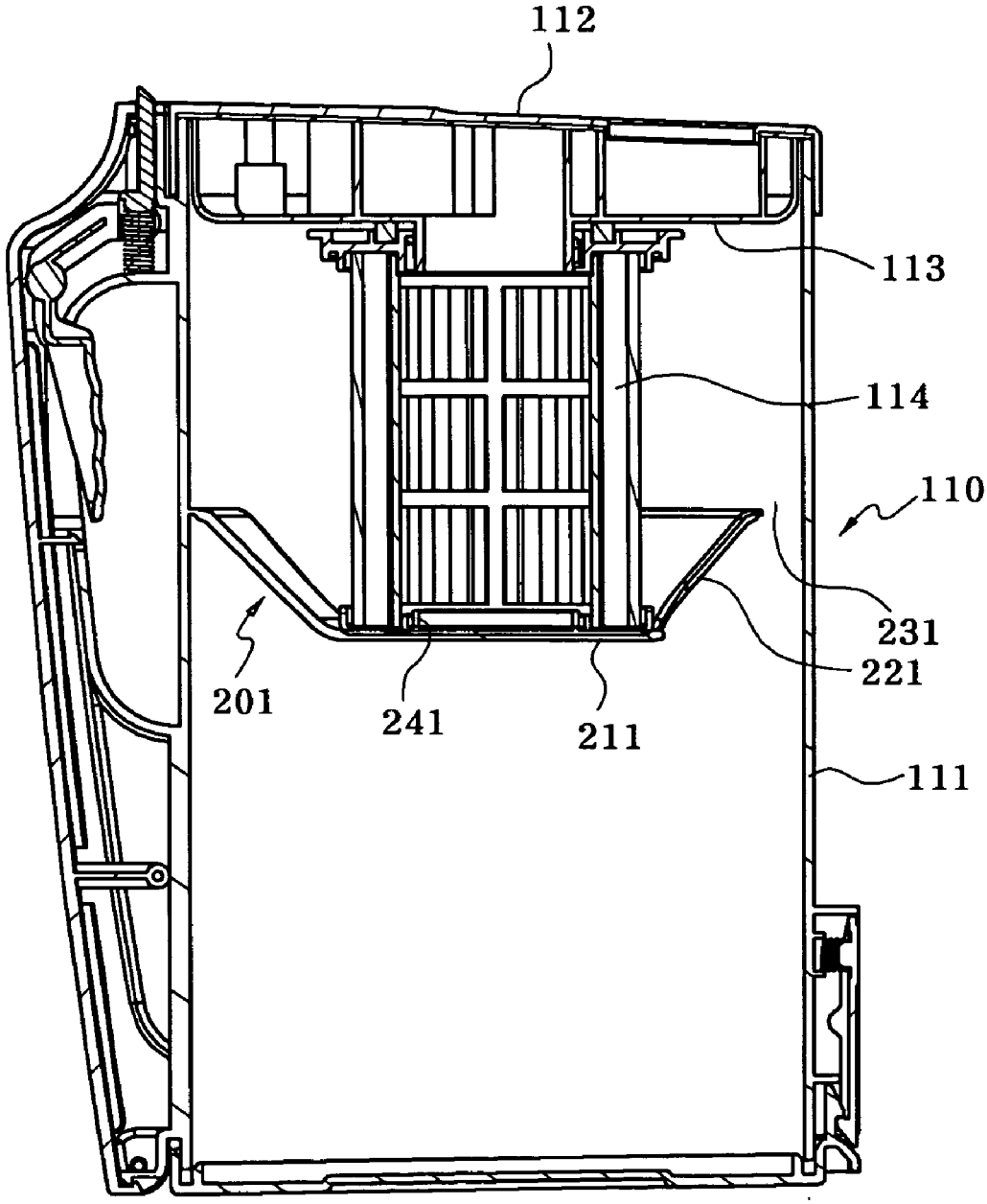
FIG. 9 is a cross-sectional view illustrating the dust container of the upright type vacuum cleaner having a supporting member according to the present invention.
Figure 10:
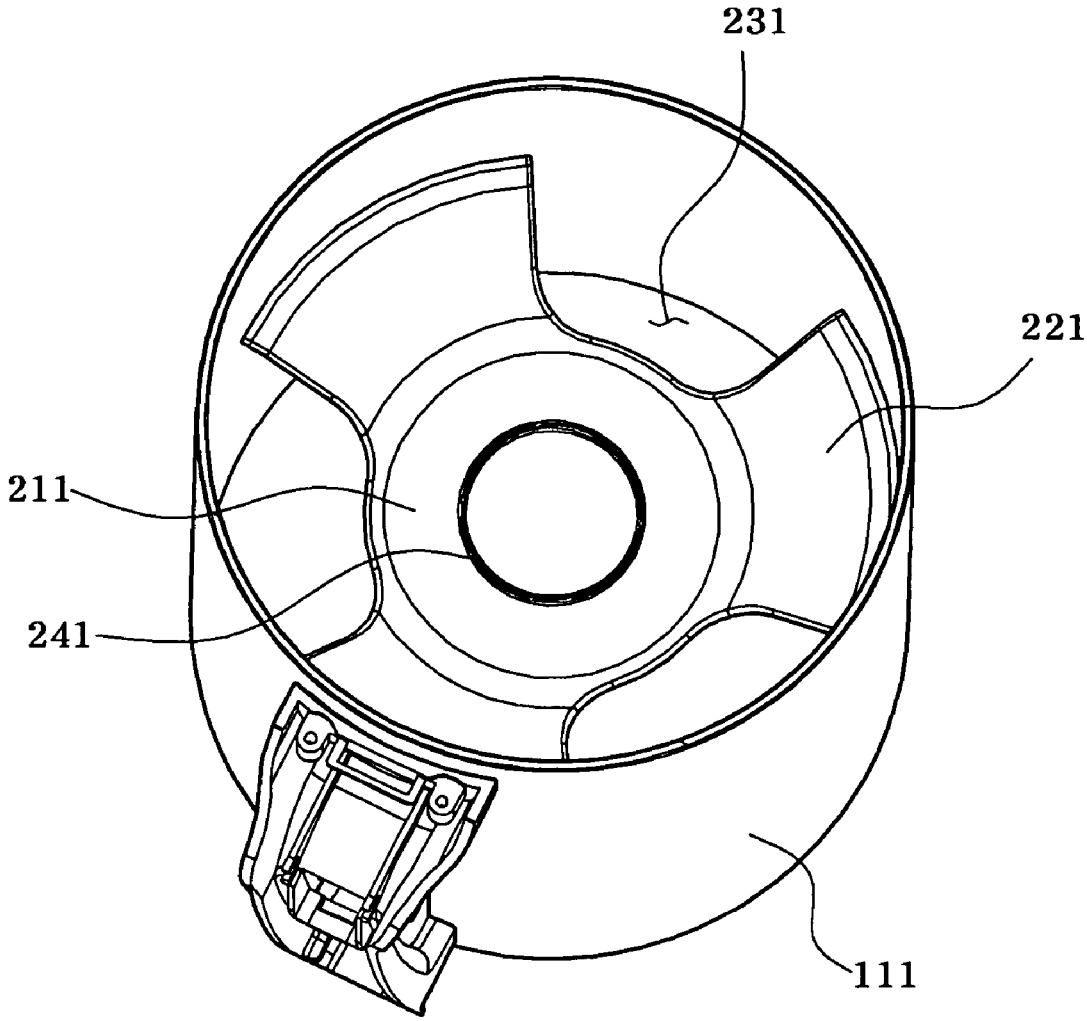
FIG. 10 is a perspective view illustrating a container body according to the present invention.

FIG. 9 is a cross-sectional view illustrating the dust container of the upright type vacuum cleaner having a supporting member according to the present invention, and FIG. 10 is a perspective view illustrating a container body according to the present invention.

As shown in the drawings, the present invention relates to a dust container of an upright type vacuum cleaner, which serves to collect foreign substances therein by removing the foreign substances from air induced thereinto while purifying the air by means of a filter, and to allow the purified air to be discharged to the outside.

For a dust container 110 of the upright type vacuum cleaner according to the present invention, a circular cover 112 is formed with a suction port and an exhaust port, and has a guide member 113 attached to a lower surface of the cover 112 to guide a flow path of air.

A filter 114 is attached to a lower surface of the guide member 30 to purify contaminated air induced into the dust container, and a cylindrical container body 111 is attached to a circumference of the lower surface of the cover 112 to receive the guide member 113 and the filter 114.

In addition, the dust container comprises a supporting member 201 attached to an inner surface of the container body 111 to support the filter 114 while contacting a lower surface of the filter 114.

At this time, the supporting member 201 comprises a supporting plate 211 located under the lower surface of the filter 114 to support the filter 114, and securing plates 221 extending from the supporting plate 211 and attached to the inner surface of the container body 111.

Here, foreign substances must be settled down to the bottom of the container body 111 in order to allow a smooth flow of the air within the container body 111, and contaminated air must be exhausted to the outside after being purified.

To this end, with at least one of the securing plates 221 separated from others, each securing plate 221 is secured at one end to the inner surface of the container body 111, and at the other end to the supporting plate 211 such that spaces are defined therebetween to act as openings 231 through which the air can flow.

Alternatively, each of the securing plates may be integrally coupled to the container body, and have a plurality of holes formed therethrough so as to permit the flow of air therethrough.

Meanwhile, the filter 114 has a cylindrical shape, an interior of which is an empty space. The supporting plate 211 is formed with a securing protrusion 241 on which an inner side of the filter 114 is seated.

Operation and effect of the dust container according to the present invention constructed as above will be described hereinafter.

A set of the cover 112 having the suction port and the exhaust port, the guide member 113 attached to the lower surface of the cover 112 to guide flow of air, and the filter attached to the lower surface of the guide member 113 to purify the air is placed on an opened upper portion of the container body 111.

Then, the cover 112 is coupled to an upper end of the container body 111 in which the guide member 113 and the filter 114 are received, and at this time, the supporting member 201 integrally formed with the container body 112 is located under the lower surface of the filter 114, thereby supporting the filter 114.

As a result, the filter 114 can support the guide member 113 and the cover 112 while being supported by the supporting member 201.

With this structure, if the central region of the cover 112 having the suction port and the exhaust port is subjected to a downward deformation due to an increase of vacuum degree within the dust container 110 resulting from driving of the vacuum cleaner, the filter 114 having the lower surface of the filter 114 supported by the supporting member 201 serves to prevent the downward deformation of the cover 112.

Meanwhile, the plurality of securing plates 221 of the supporting plate 201 are separated from each other, and secured to the inner side of the container body 111, so that the supporting member 201 can support the filter 114 without obstructing air flow within the container body 111.

According to the present invention, the dust container of the vacuum cleaner according to the present invention comprises the cover which is positioned on the upper end of the dust container, and has the suction port and the exhaust port formed thereon, thereby preventing reduction in suction force even when a vacuum degree is increased due to operation of the vacuum cleaner.

In addition, although the guide member is attached as a single component to the lower surface of the cover, it has the necessary shapes to guide suction and exhaust of air, thereby reducing manufacturing costs while enhancing assembling efficiency.

In addition, the dust container of the present invention comprises a single gasket which serves to seal between the cover and the guide member and between the cover and the container body, thereby ensuring effective sealing of the dust container.

In addition, the dust container of the present invention comprises the ribs, which extend from the suction port and the exhaust port from the lower surface of the cover, and serve not only as air passages, but also as sealing members to prevent air leakage when the air is induced or exhausted.

In addition, according to the present invention, with the supporting structure for the cover of the dust container of the upright type vacuum cleaner, the supporting member supports the lower surface of the filter coupled to the lower surface of the cover, thereby preventing the cover having the suction port and the exhaust port from being deformed downward due to driving of the vacuum cleaner.

Furthermore, the supporting member comprises the supporting plate supporting the lower surface of the filter, and the securing plates extending from the supporting plate such that, with at least one of the securing plates separated from others, each securing plate is secured at one end to the inner surface of the container body to form openings, thereby allowing a smooth flow of air within the container body while supporting the filter.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A dust container of an upright type vacuum cleaner, comprising:

a circular cover having a suction port and an exhaust port;

a guide member attached to a lower surface of the cover to guide a flow path of air;

a filter attached to a lower surface of the guide member;

a cylindrical container body provided to the lower surface of the cover to receive the guide member and the filter therein, wherein the guide member comprises a suction guide part to guide air induced into the dust container through the suction port of the cover to spirally rotate within the container body; and an exhaust guide part to guide air discharged towards a center of the filter to the exhaust port of the cover.

2. The dust container according to claim 1, wherein the suction guide part comprises a suction guide plate to guide the induced air to rotate, and a slanted plate formed at a distal end of the suction guide plate and having a slanted opening defined therein to guide the induced air to move towards the container body.

3. The dust container according to claim 1, wherein the exhaust guide part comprises an exhaust hole through which the air purified by the filter is exhausted to the outside, and an exhaust guide plate to guide the air exhausted through the exhaust hole to the exhaust port of the cover.

4. The dust container according to claim 1, further comprising:

a gasket between the guide member and the cover.

5. The dust container according to claim 4, wherein the gasket has a larger diameter than that of the cover.

6. The dust container according to claim 1, further comprising:

ribs extending with different lengths from the suction port and the exhaust port on the lower surface of the cover to the guide parts, respectively.

7. A dust container of an upright type vacuum cleaner, comprising:

a circular cover having a suction port and an exhaust port;

a guide member attached to a lower surface of the cover to guide a flow path of air;

a filter attached to a lower surface of the guide member;

a cylindrical container body provided to the lower surface of the cover to receive the guide member and the filter therein;

ribs extending with different lengths from the suction port and the exhaust port on the lower surface of the cover to the guide parts, respectively.

8. A supporting structure for a cover of a dust container of an upright type vacuum cleaner, comprising:

a circular cover having a suction port and an exhaust port;

a guide member attached to a lower surface of the cover to guide a flow path of air;

a filter attached to a lower surface of the guide member;

a cylindrical container body provided to the lower surface of the cover to receive the guide member and the filter therein; and a supporting member provided to an inner side of the container body to support the filter.

9. The supporting structure according to claim 8, wherein the supporting member comprises a supporting plate located under a lower surface of the filter to support the filter, and securing plates extending from the supporting plate and coupled to the inner side of the container body.

10. The supporting structure according to claim 9, wherein at least one of the securing plates is separated from others to define spaces therebetween, the spaces being formed with openings through which the air can flow.

11. The supporting structure according to claim 9, wherein the supporting plate is formed with a securing protrusion on which the filter is seated.

* * * * *